US010197055B2

(12) United States Patent
Honda et al.

(10) Patent No.: US 10,197,055 B2
(45) Date of Patent: Feb. 5, 2019

(54) OIL PUMP DEVICE

(71) Applicant: MAZDA MOTOR CORPORATION, Hiroshima (JP)

(72) Inventors: Kenta Honda, Aki-gun (JP); Tomohiro Koguchi, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 317 days.

(21) Appl. No.: 15/164,128

(22) Filed: May 25, 2016

(65) Prior Publication Data

US 2016/0348673 A1 Dec. 1, 2016

(30) Foreign Application Priority Data

May 28, 2015 (JP) ..... 2015-108460

(51) Int. Cl.
*F04C 14/22* (2006.01)
*F04C 2/344* (2006.01)
(Continued)

(52) U.S. Cl.
CPC ..... *F04C 14/226* (2013.01); *F01M 1/02* (2013.01); *F01M 1/06* (2013.01); *F04C 2/344* (2013.01);
(Continued)

(58) Field of Classification Search
CPC .. F01M 1/02; F01M 1/06; F01M 1/16; F01M 2001/0207; F01M 2001/0215;
(Continued)

(56) References Cited

U.S. PATENT DOCUMENTS 3,784,326 A * 1/1974 Lagana ..... F04B 49/08 417/221
5,141,418 A * 8/1992 Ohtaki ..... F04C 14/226 417/310

(Continued)

FOREIGN PATENT DOCUMENTS

JP 2013-142297 A 7/2013
JP 2013142297 A * 7/2013
JP 2014-051924 A 3/2014

*Primary Examiner* — Kenneth J Hansen
*Assistant Examiner* — Chirag Jariwala
(74) *Attorney, Agent, or Firm* — Studebaker & Brackett PC

(57) ABSTRACT

An oil pump device includes an oil pump (10) and an electrically operated control valve (20). The valve adjusts hydraulic pressures to be applied to a decrease-side control pressure chamber (15A) for causing a pump casing (14) to swing in the discharge amount decrease direction and an increase-side control pressure chamber (15B) for causing the pump casing to swing in the discharge amount increase direction so as to hold the pump casing at a predetermined approximately intermediate position between the maximum swing position in the discharge amount decrease direction and the maximum swing position in the discharge amount increase direction by balancing the urging forces of a decrease-side return spring (16) for urging the pump casing in the discharge amount decrease direction and an increase-side return spring (17) for urging the pump casing in the discharge amount increase direction when supply of current to the valve is stopped.

6 Claims, 9 Drawing Sheets

(51) Int. Cl.
*F01M 1/02* (2006.01)
*F01M 1/06* (2006.01)

(52) U.S. Cl.
CPC ..... *F01M 2001/0215* (2013.01); *F01M 2001/0238* (2013.01); *F01M 2001/0246* (2013.01)

(58) Field of Classification Search
CPC .... F01M 2001/0238; F01M 2001/0246; F04C 2/344; F04C 14/18; F04C 14/22; F04C 14/226
USPC ..... 417/218, 220, 221; 418/24–27, 30, 31, 418/259
See application file for complete search history.

(56) References Cited

U.S. PATENT DOCUMENTS

2014/0072456 A1 3/2014 Watanabe et al.
2017/0291661 A1* 10/2017 Lee ..... B62M 19/00

* cited by examiner

OIL PUMP DEVICE

BACKGROUND OF THE INVENTION

1. Field of the Invention

The present invention relates to an oil pump device for an engine, specifically, to the oil pump device including a mechanical oil pump to be driven by a crankshaft, and more specifically, to a variable-capacity oil pump.

2. Background Art

Conventionally, in an engine to be installed in an automobile, a mechanical oil pump to be driven by a crankshaft is used to supply, to each part of the engine, engine oil (hereinafter, simply called as oil) for lubricating or cooling a crankshaft, and bearing portions and sliding portions of a camshaft, or for operating a hydraulically operated device such as a VVT. The required amount of oil or the required hydraulic pressure differs depending on an operating state of the engine (such as an engine speed, a load, or a temperature). In view of the above, in a fixed-capacity oil pump, oil of a predetermined flow rate is discharged from the oil pump, and a relief valve provided in a discharge passage is controlled depending on an operating state of the engine to supply oil of a required amount to each part of the engine. However, oil of an amount exceeding the required amount is returned to an oil pan. Therefore, the work of the oil pump by the excessive amount of oil may be useless. This may deteriorate the fuel economy.

In view of the above, there is known a variable-capacity oil pump capable of changing the discharge amount, namely, the hydraulic pressure (discharge pressure) while being driven by a crankshaft. In the variable-capacity oil pump, it is possible to control discharge of oil by a required amount. This makes it possible to suppress useless work of the oil pump. For instance, Japanese Unexamined Patent Publication No. 2013-142297 (hereinafter, called as Patent Literature 1) discloses a technique in which supply of a hydraulic pressure to a decrease-side control pressure chamber for causing a pump casing of the variable capacity oil pump to swing toward the decrease side and to an increase-side control pressure chamber for causing the pump casing of the variable-capacity oil pump to swing toward the increase side is switched by an electrically operated control valve (electromagnetic spool valve) when the engine is operated in a low load operation mode and in a middle to high load operation mode so as to adjust the discharge amount of the oil pump to increase or decrease depending on an operating state of the engine.

In the technique disclosed in Patent Literature 1, when the engine is in a warm-up operation mode or in a low load operation mode after the engine is started, excitation current is supplied to the electrically operated control valve (energized state). Then, a hydraulic pressure is supplied to the decrease-side control pressure chamber, and the pump casing is caused to swing toward the decrease side. Thus, the discharge amount of the oil pump decreases. On the other hand, when the engine is operated in a middle to high load operation mode after a warm-up operation is completed, the supply of excitation current to the electrically operated control valve is stopped (non-energized state). Then, a hydraulic pressure is supplied to the increase-side control pressure chamber, and the pump casing is caused to swing toward the increase side. Thus, the discharge amount of the oil pump increases. The increase-side control pressure chamber is provided with a return spring for constantly urging the pump casing toward the increase side all the time including a time when a hydraulic pressure is not supplied to the increase-side control pressure chamber.

In the aforementioned configuration, electric power consumption may increase because excitation current is constantly supplied to the electrically operated control valve when the engine is operated in a low load operation mode, which is frequently used for the engine. In addition to the above, it is necessary to apply a force exceeding the urging force of the return spring in order to swing the pump casing toward the decrease side. In order to decrease the discharge amount of the oil pump with enhanced responsiveness, it is necessary to supply a relatively high hydraulic pressure to the decrease-side control pressure chamber. Particularly, the latter issue is serious because the hydraulic pressure tends to lower when oil of a low viscosity is used in order to improve the fuel economy.

As another example of the aforementioned variable-capacity oil pump, Japanese Unexamined Patent Publication No. 2014-51924 (hereinafter, called as Patent Literature 2) discloses an oil pump provided with, in addition to a first coil spring (return spring) for urging a pump casing toward the increase side, a second coil spring for urging the pump casing toward the decrease side.

However, in Patent Literature 2, the spring load (resilient force) of each of the first coil spring and the second coil spring is set to be such a value that the pump casing is urged to a maximum swing position (maximum eccentric position) on the increase side when the oil pump is stopped. In other words, the oil pump disclosed in Patent Literature 2 has basically the same configuration as the oil pump disclosed in Patent Literature 1. In Patent Literature 2, the second coil spring merely and temporarily assists movement of the pump casing in the initial stage when the pump casing is caused to swing toward the decrease side. Therefore, the oil pump disclosed in Patent Literature 2 also fails to solve the problem involved in Patent Literature 1.

SUMMARY OF THE INVENTION

In view of the aforementioned drawback involved in a variable-capacity oil pump, an object of the invention is to provide an oil pump device that enables to suppress electric power consumption of an electrically operated control valve, and to control the discharge amount of the oil pump with enhanced responsiveness even when oil of a low viscosity is used.

An oil pump device according to an aspect of the invention is an oil pump device for an engine. The oil pump device is provided with an oil pump, and an electrically operated control valve which changes a discharge amount of oil from the oil pump. The oil pump includes: a pump body provided with an oil suction port and an oil discharge port; a pump element disposed inside the pump body, and configured to rotate by a driving force of a crankshaft; a pump casing disposed inside the pump body and around the pump element, the pump casing forming a plurality of pump chambers by cooperation with the pump element, the pump chambers communicating with the suction port and with the discharge port one after another, as the pump element is rotated, the pump casing being supported by the pump body to swing in a discharge amount decrease direction and in a discharge amount increase direction, the discharge amount decrease direction being such that a capacity of the pump chamber located at a position close to the suction port increases and a capacity of the pump chamber located at a position close to the discharge port decreases, the discharge amount increase direction being opposite to the discharge amount decrease direction, and being such that a capacity of the pump chamber located at a position close to the discharge port increases and a capacity of the pump chamber located at a position close to the suction port decreases; a decrease-side control pressure chamber defined by the pump body and the pump casing, and configured to cause the pump casing to swing in the discharge amount decrease direction in response to receiving a hydraulic pressure; an increase-side control pressure chamber defined by the pump body and the pump casing, and configured to cause the pump casing to swing in the discharge amount increase direction in response to receiving a hydraulic pressure; a decrease-side return spring disposed in the decrease-side control pressure chamber in a compressed state between the pump body and the pump casing, and configured to constantly urge the pump casing in the discharge amount decrease direction; and an increase-side return spring disposed in the increase-side control pressure chamber in a compressed state between the pump body and the pump casing, and configured to constantly urge the pump casing in the discharge amount increase direction. The electrically operated control valve adjusts the hydraulic pressure to be applied to the decrease-side control pressure chamber and the hydraulic pressure to be applied to the increase-side control pressure chamber so as to hold the pump casing at a predetermined position by balancing an urging force of the decrease-side return spring and an urging force of the increase-side return spring when supply of current to the electrically operated control valve is stopped, the predetermined position being an approximately intermediate position between a maximum swing position in the discharge amount decrease direction and a maximum swing position in the discharge amount increase direction, and being a position where the capacity of the pump chamber located at the position close to the suction port and the capacity of the pump chamber located at the position close to the discharge port are approximately equal to each other.

These and other objects, features and advantages of the present invention will become more apparent upon reading the following detailed description along with the accompanying drawings.

DETAILED DESCRIPTION OF THE PREFERRED EMBODIMENTS OF THE INVENTION

Figure 1:
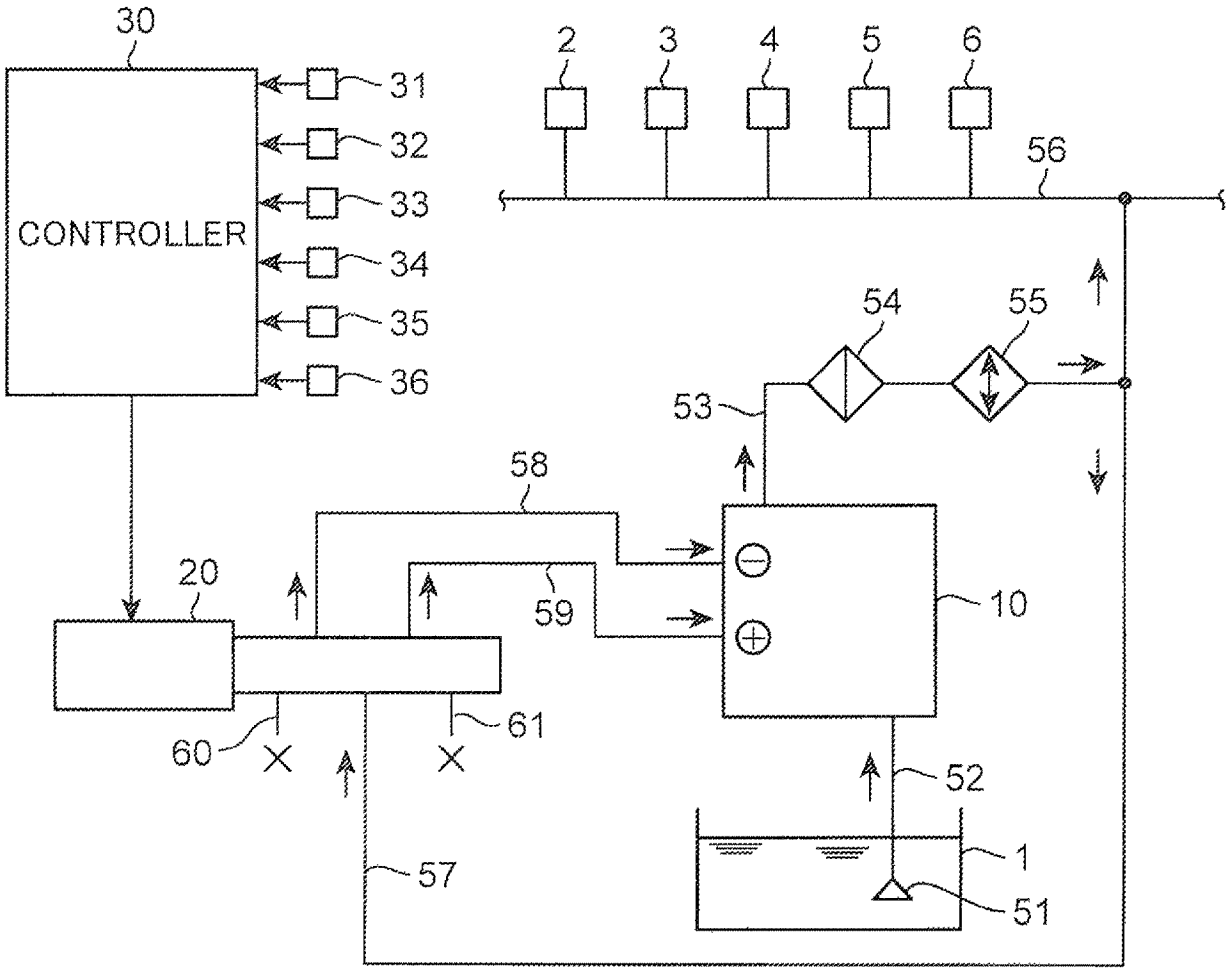
FIG. 1 is an overall configuration diagram illustrating an oil pump device embodying the invention.

In the following, an embodiment of the invention is described referring to the drawings.

An oil pump device embodying the invention includes a variable-capacity oil pump 10. As illustrated in FIG. 1, the oil pump 10 is driven by a crankshaft 2 of an unillustrated engine. After oil stored in an oil pan 1 is sucked from a suction oil passage 52 via a strainer 51, oil of a predetermined pressure is discharged from an oil discharge passage 53 to a main gallery 56 (corresponding to an oil supply passage of the invention) via an oil filter 54 and an oil cooler 55. A control pressure passage 57 branched from the oil discharge passage 53 is connected to a linear solenoid valve 20 (corresponding to an electrically operated control valve of the invention) at a position downstream of the oil cooler 55. The linear solenoid valve 20 is controlled by a controller 30 by a duty ratio (={energized time/(energized time+non-energized time)}×100(%)). A control hydraulic pressure supplied from the control pressure passage 57 is supplied to a decrease-side oil passage 58 and to an increase-side oil passage 59. The controller 30 is composed of a well-known microcomputer including a CPU, an ROM, and an RAM. The controller 30 corresponds to a target hydraulic pressure setting device and a control device of the invention.

Figure 2:
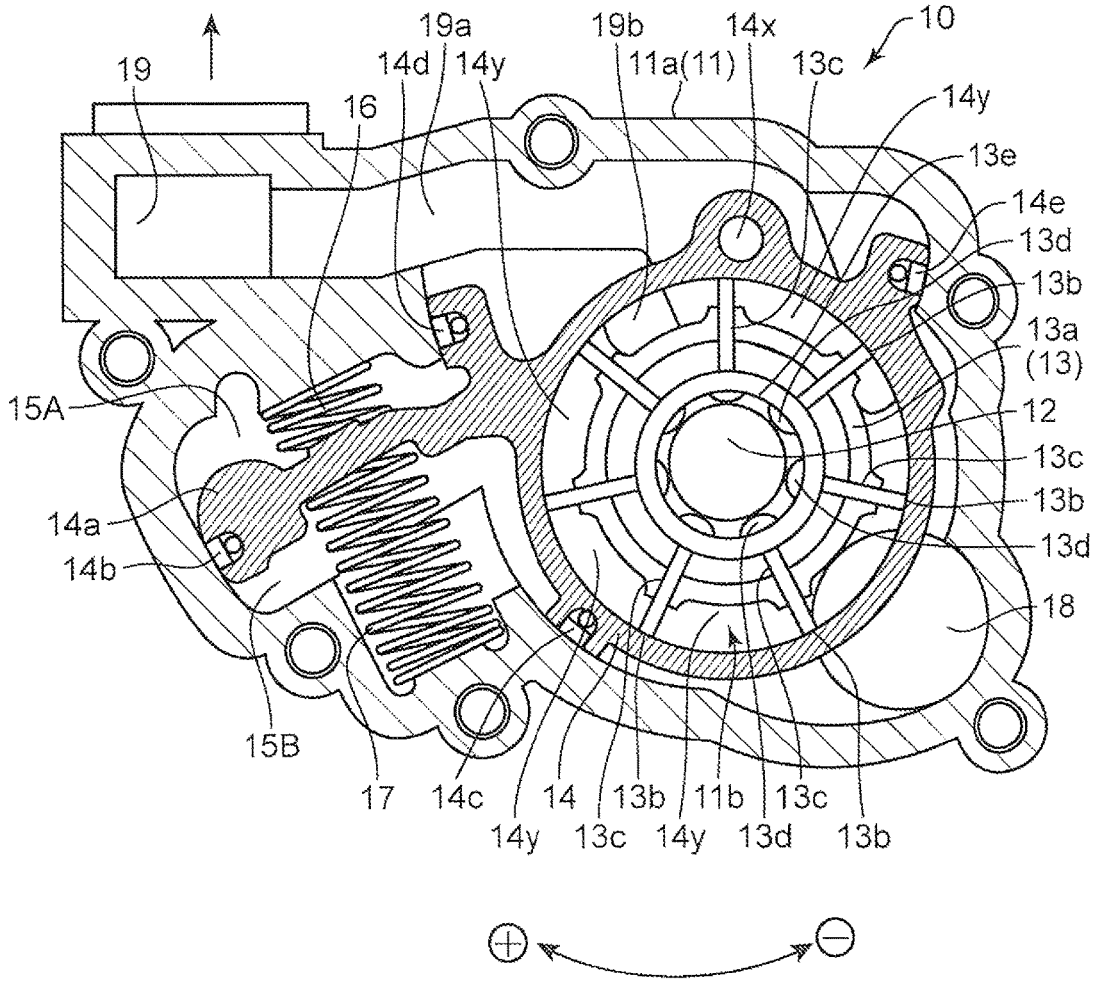
FIG. 2 is an overall diagram illustrating an operating state of an oil pump when an electrically operated control valve is in a non-energized state.
Figure 3:
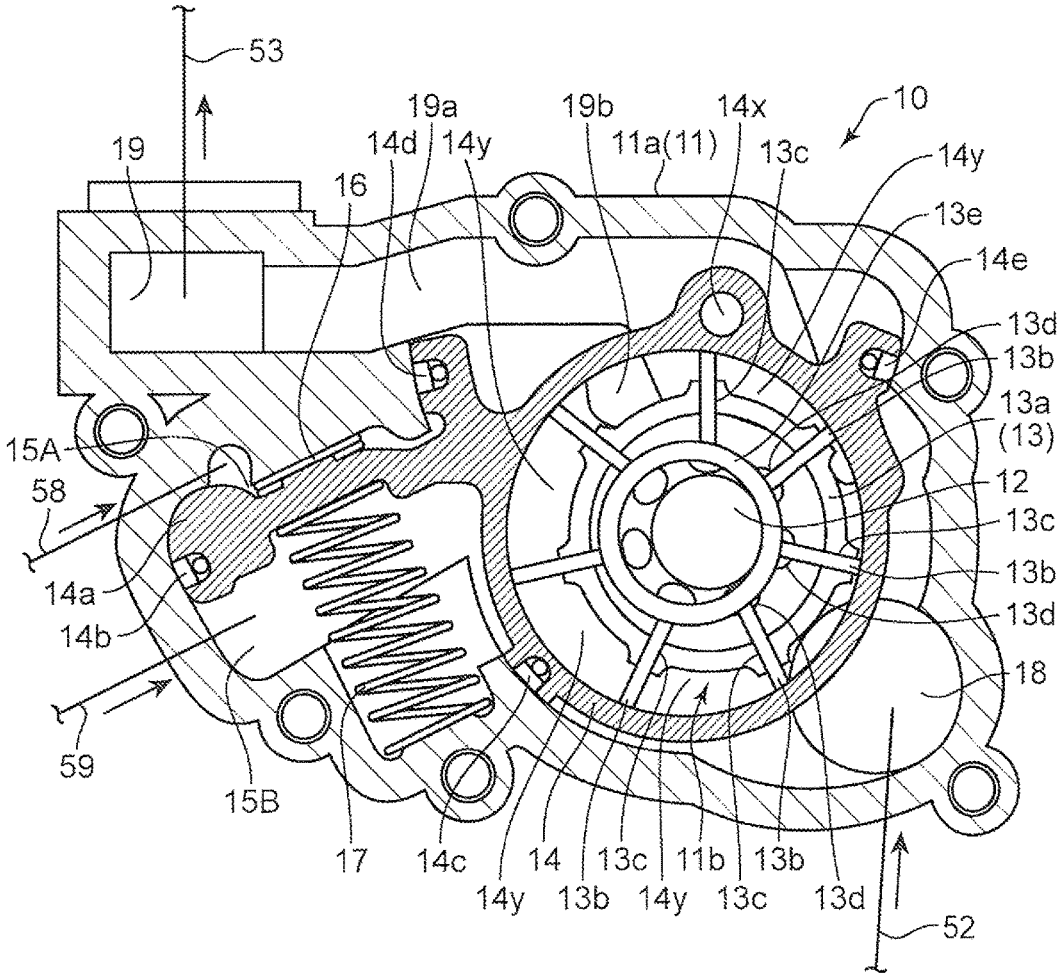
FIG. 3 is an overall diagram illustrating an operating state of the oil pump when the oil pump is in a maximum discharge state.
Figure 4:
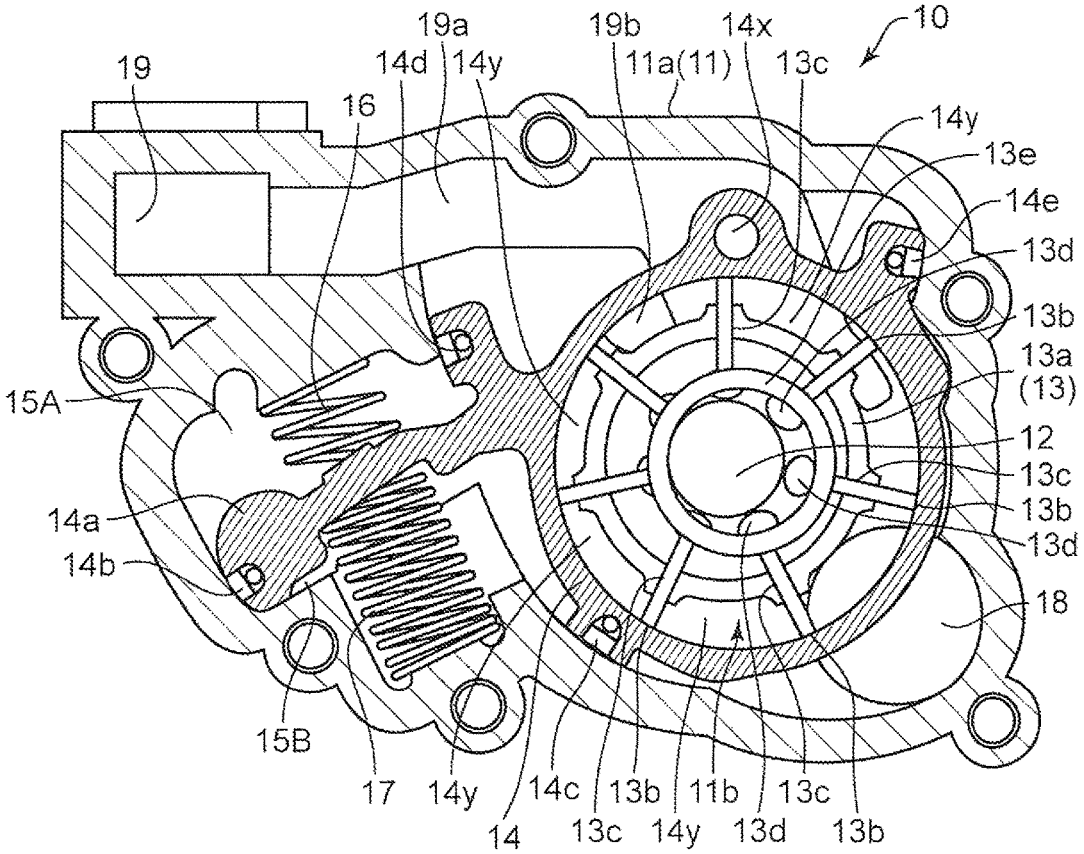
FIG. 4 is an overall diagram illustrating an operating state of the oil pump when the oil pump is in a minimum discharge state.

As illustrated in FIG. 2 to FIG. 4, the oil pump 10 is provided with a pump housing 11, a drive shaft 12, a pump element 13, a pump casing 14, a decrease-side return spring 16, an increase-side return spring 17, and a ring member 13*e*.

The pump housing 11 has an opening end thereof on the front side in FIG. 2 to FIG. 4. The pump housing 11 includes a pump body 11*a* of U-shape in section. A pump accommodation chamber 11*b* including a columnar-shaped space therein is formed in the pump body 11*a*. The opening in the one end of the pump body 11*a* is closed by an unillustrated cover member.

The drive shaft 12 is pivotally supported by the pump body 11*a*. The drive shaft 12 passes through an approximately center portion of the pump accommodation chamber 11*b*, and is pivotally driven by the crankshaft 2.

The pump element 13 is rotatably accommodated in the pump accommodation chamber 11*b*. The pump element 13 includes a columnar-shaped rotor 13*a*, whose center portion is connected to the drive shaft 12. A plurality of slits 13*c* (in the example illustrated in FIG. 2 to FIG. 4, seven slits) are radially formed in the outer periphery of the rotor 13*a*. Vanes 13*b* are accommodated in the respective slits 13*c* to project and retract with respect to the outer peripheral surface of the rotor 13*a*.

The pump casing 14 is a tubular member disposed around the pump element 13. The pump casing 14 is eccentrically disposed with respect to the center (drive shaft 12) of rotation of the rotor 13*a*. Specifically, the pump casing 14 is disposed to swing rightward (counterclockwise as illustrated by the minus arrow direction in FIG. 2, corresponding to a discharge amount decrease direction of the invention) or leftward (clockwise as illustrated by the plus arrow direction in FIG. 2, corresponding to a discharge amount increase direction of the invention) around a pivot point 14*x* formed in the pump body 11*a*. A plurality of pump chambers 14*y* (in the example illustrated in FIG. 2 to FIG. 4, seven pump chambers) are defined in the pump casing 14 by cooperation with the outer peripheral surface of the rotor 13*a* and the vanes 13*b* projecting outwardly from the outer peripheral surface of the rotor 13*a*. The pump chambers 14*y* communicate with a suction hole 18 to be described later and with a discharge hole 19 to be described later one after another, as the rotor 13*a* is rotated.

The pump casing 14 includes an arm portion 14*a* extending outwardly from the outer surface of the pump casing 14. Each of a decrease-side control pressure chamber 15A and an increase-side control pressure chamber 15B is defined by the pump body 11*a* and the arm portion 14*a* in a state that the decrease-side control pressure chamber 15A and the increase-side control pressure chamber 15B are formed opposite to each other with respect to the arm portion 14*a*. The decrease-side return spring 16 is disposed in the decrease-side control pressure chamber 15A in a compressed state between the pump body 11*a* and the arm portion 14*a*. The increase-side return spring 17 is disposed in the increase-side control pressure chamber 15B in a compressed state between the pump body 11*a* and the arm portion 14*a*. The decrease-side return spring 16 constantly urges the pump casing 14 rightward (toward the decrease side) with respect to the pivot point 14*x* via the arm portion 14*a*, and the increase-side return spring 17 constantly urges the pump casing 14 leftward (toward the increase side) with respect to the pivot point 14*x* via the arm portion 14*a*.

The ring member 13*e* is disposed around the drive shaft 12. The ring member 13*e* is disposed in a pair on one end of the drive shaft 12 and on the other end of the drive shaft 12 with respect to the rotor 13*a* (in FIG. 2 to 4, only one end of the drive shaft 12 is illustrated). An inner end of each vane 13*b* comes into contact with the outer peripheral surface of the ring member 13*e*. In FIG. 2 to FIG. 4, the reference numeral 13*d* denotes a back pressure chamber formed in the rotor 13*a* in order to be inserted the inner end of each vane 13*b*. The vanes 13*b* are pushed outwardly by a centrifugal force of the ring member 13*e*, which is generated as the rotor 13*a* is rotated, and by a hydraulic pressure to be supplied to the back pressure chamber 13*d*. The outer end of each vane 13*b* comes into pressing contact with the inner surface of the pump casing 14.

The pump body 11*a* is formed with the suction hole 18 to be connected to the suction oil passage 52, and the discharge hole 19 to be connected to the discharge oil passage 53. The decrease-side oil passage 58 is connected to the decrease-side control pressure chamber 15A, and the increase-side oil passage 59 is connected to the increase-side control pressure chamber 15B.

A first seal member 14*b*, a second seal member 14*c*, a third seal member 14*d*, and a fourth seal member 14*e* are mounted on the outer surface of the pump casing 14 in pressing contact with the inner surface of the pump body 11*a*. The first seal member 14*b* is disposed on the tip end of the arm portion 14*a*. The second seal member 14*c* is disposed at a position corresponding to the decrease side with respect to the first seal member 14*b*. The third seal member 14*d* is disposed at a position corresponding to the increase side with respect to the first seal member 14*b*. The fourth seal member 14*e* is disposed on the radially opposite side of the pump casing 14 with respect to the first seal member 14*b*. The first seal member 14*b* and the second seal member 14*c* oil-tightly seal the increase-side control pressure chamber 15B. The first seal member 14*b* and the third seal member 14*d* oil-tightly seal the decrease-side control pressure chamber 15A. The fourth seal member 14*e* and the second seal member 14*c* oil-tightly seal the suction hole 18. The fourth seal member 14*e* and the third seal member 14*d* oil-tightly seal the discharge hole 19.

FIG. 2 illustrates an operating state of the oil pump when the discharge pressure (discharge amount) of the oil pump 10 is set to an approximately intermediate discharge pressure (intermediate discharge amount) between the maximum discharge pressure (maximum discharge amount) and the minimum discharge pressure (minimum discharge amount). In this state, the arm portion 14*a* is moved away from the decrease-side wall portion of the pump body 11*a* and from the increase-side wall portion of the pump body 11*a* by substantially the same distance. As a result, the capacity of the pump chamber 14*y* located at a position close to the suction hole 18, and the capacity of the pump chamber 14*y* located at a position close to the discharge hole 19 become substantially equal to each other. Thus, the discharge pressure of the oil pump 10 becomes equal to the intermediate discharge pressure. Specifically, the position of the pump casing 14 in the aforementioned state is called as an approximately intermediate position (corresponding to a predetermined position of the invention) between the maximum swing position on the decrease side and the maximum swing position on the increase side. The approximately intermediate position may not only include an exactly intermediate position but also include a position in the vicinity of the intermediate position, which is regarded to be the intermediate position.

FIG. 3 illustrates an operating state of the oil pump when the discharge pressure of the oil pump 10 is equal to the maximum discharge pressure. In this state, the arm portion 14*a* comes into contact with the increase-side wall portion of the pump body 11*a*. As a result, the capacity of the pump chamber 14*y* located at a position close to the discharge hole 19 becomes largest with respect to the capacity of the pump chamber 14*y* located at a position close to the suction hole 18. Thus, the discharge pressure of the oil pump 10 becomes equal to the maximum discharge pressure. Specifically, the position of the pump casing 14 in this state is called as the maximum swing position on the increase side.

FIG. 4 illustrates an operating state of the oil pump when the discharge pressure of the oil pump 10 is equal to the minimum discharge pressure. In this state, the arm portion 14*a* comes into contact with the decrease-side wall portion of the pump body 11*a*. As a result, the capacity of the pump chamber 14*y* located at a position close to the discharge hole 19 becomes smallest with respect to the capacity of the pump chamber 14*y* located at a position close to the suction hole 18. Thus, the discharge pressure of the oil pump 10 becomes equal to the minimum discharge pressure. Specifically, the position of the pump casing 14 in this state is called as the maximum swing position on the decrease side.

In other words, the pump casing 14 is supported by the pump body 11*a* in such a manner that the pump casing 14 is caused to swing in the discharge amount decrease direction (rightward in FIG. 2 to FIG. 4) in which the capacity of the pump chamber 14*y* located at a position close to the suction hole 18 increases and the capacity of the pump chamber 14*y* located at a position close to the discharge hole 19 decreases, and in the discharge amount increase direction (leftward in FIG. 2 to FIG. 4), which is opposite to the discharge amount decrease direction, and in which the capacity of the pump chamber 14*y* located at a position close to the discharge hole 19 increases and the capacity of the pump chamber 14*y* located at a position close to the suction hole 18 decreases.

In FIG. 2 to FIG. 4, the reference numerals 19*a* and 19*b* denote discharge ports for communicating between the pump chambers 14*y* located at a position close to the discharge hole 19, and the discharge hole 19.

Figure 5:
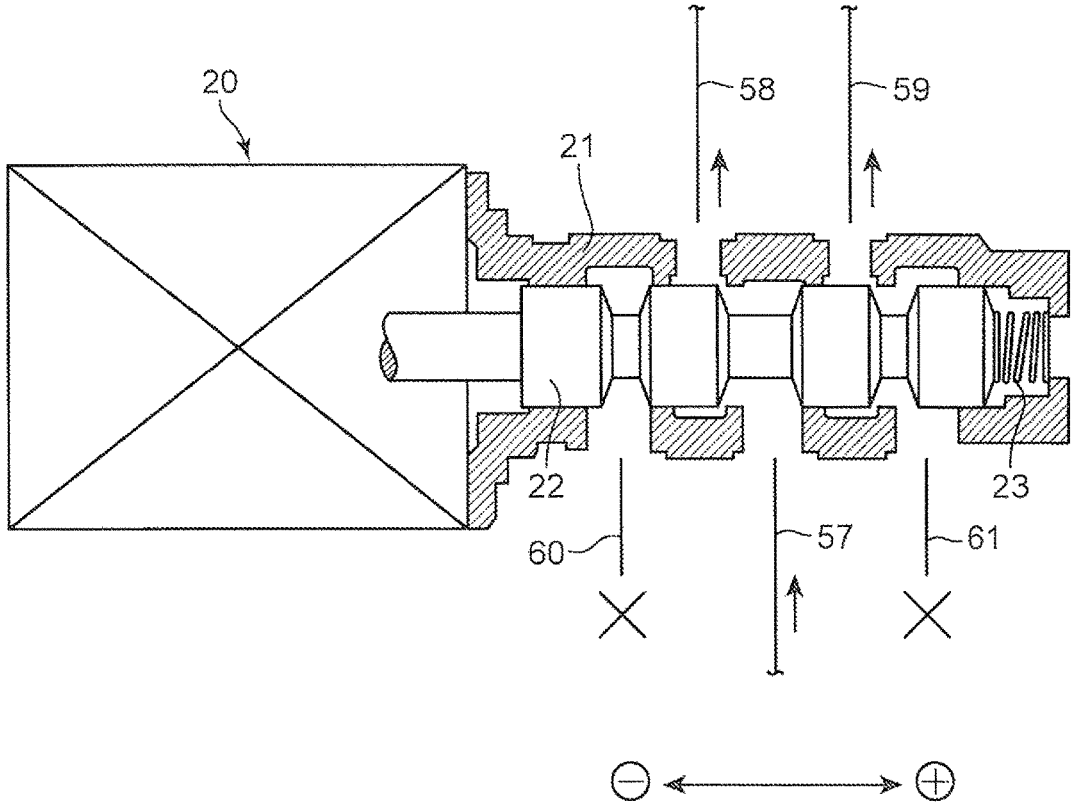
FIG. 5 is an overall diagram illustrating a configuration of the electrically operated control valve.
Figure 6:
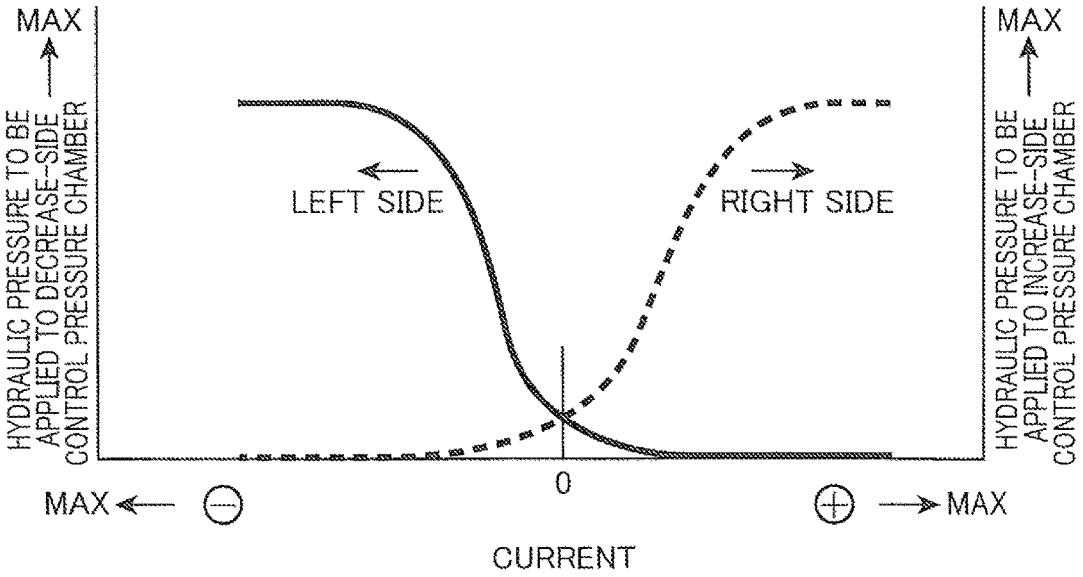
FIG. 6 is a characteristic diagram illustrating a relationship between an applied current to the electrically operated control valve, and a generated hydraulic pressure.

FIG. 5 is an overall diagram illustrating a configuration of the linear solenoid valve 20. FIG. 6 is a characteristic diagram illustrating a relationship between an applied current to the linear solenoid valve 20, and a generated hydraulic pressure.

As illustrated in FIG. 5, the linear solenoid valve 20 includes unillustrated two solenoids, a valve body 21, and a spool 22, which is axially and movably accommodated in the valve body 21. The valve body 21 is formed with a port connected to the control pressure oil passage 57, a port connected to the decrease-side oil passage 58, a port connected to the increase-side oil passage 59, a port connected to a decrease-side drain oil passage 60, and a port connected to an increase-side drain oil passage 61.

FIG. 5 illustrates a state in which the spool 22 is moved from a non-energized state (a state in which the applied current to the linear solenoid valve 20 is zero) to a position slightly close to the decrease side (left side in FIG. 5). When the linear solenoid valve 20 is in a non-energized state, the spool 22 is moved to a position slightly close to the increase side (right side in FIG. 5) than the illustrated position. As a result, the degree of communication (communication state) between the control pressure oil passage 57 and the decrease-side oil passage 58 becomes substantially zero, the degree of communication between the control pressure oil passage 57 and the increase-side oil passage 59 becomes substantially zero, the degree of communication between the decrease-side oil passage 58 and the decrease-side drain passage 60 becomes substantially zero, and the degree of communication between the increase-side oil passage 59 and the increase-side drain oil passage 61 becomes substantially zero. In FIG. 5, a valve spring 23 disposed on the right end of the spool 22 has an elastic restoring force such that the spool 22 is located at the aforementioned position when the linear solenoid valve is in a non-energized state. According to this configuration, as illustrated in FIG. 6, the hydraulic pressure (see the solid line) of the decrease-side control pressure chamber 15A and the hydraulic pressure (see the broken line) of the increase-side control pressure chamber 15B decrease substantially equally. In other words, a difference in hydraulic pressure between the decrease-side control pressure chamber 15A and the increase-side control pressure chamber 15B becomes substantially zero. Thus, the pump casing 14 is held at the approximately intermediate position between the maximum swing position on the decrease side and the maximum swing position on the increase side, as illustrated in FIG. 2, by balancing the urging force of the decrease-side return spring 16 and the urging force of the increase-side return spring 17. In other words, each of the decrease-side return spring 16 and the increase-side return spring 17 has a resilient force capable of holding the pump casing 14 at the aforementioned approximately intermediate position when the linear solenoid valve 20 is in the non-energized state.

When current flows through one of the unillustrated solenoids of the linear solenoid valve 20 in a predetermined first direction (corresponding to a first current supply state of the invention), the spool 22 is retracted into the linear solenoid valve 20 and is moved toward the decrease side (left side in FIG. 5). As a result, the degree of communication between the control pressure oil passage 57 and the decrease-side oil passage 58 increases, the degree of communication between the control pressure oil passage 57 and the increase-side oil passage 59 decreases, the degree of communication between the decrease-side oil passage 58 and the decrease-side drain oil passage 60 decreases, and the degree of communication between the increase-side oil passage 59 and the increase-side drain oil passage 61 increases. Thus, as illustrated in FIG. 6, the hydraulic pressure (see the solid line) of the decrease-side control pressure chamber 15A increases, and the hydraulic pressure (see the broken line) of the increase-side control pressure chamber 15B decreases. When the duty ratio of applied current in the first direction is 50%, the hydraulic pressure of the decrease-side control pressure chamber 15A maximally increases. Thus, the pump casing 14 is held at the maximum swing position on the decrease side, as illustrated in FIG. 4 (e.g. a warm-up operation mode after the engine in a cold state is started or a low load operation mode). Specifically, the linear solenoid valve 20 adjusts the hydraulic pressure to be applied to the decrease-side control pressure chamber 15A and the hydraulic pressure to be applied to the increase-side control pressure chamber 15B to be equal to the hydraulic pressure when the pump casing 14 is held at the maximum swing position in the discharge amount decrease direction.

When current flows through the other one of the unillustrated solenoids of the linear solenoid valve 20 in a predetermined second direction opposite to the first direction, (corresponding to a second current supply state of the invention), the spool 22 is projected from the linear solenoid valve 20, and is moved toward the increase side (right side in FIG. 5). As a result, the degree of communication between the control pressure oil passage 57 and the decrease-side oil passage 58 decreases, the degree of communication between the control pressure oil passage 57 and the increase-side oil passage 59 increases, the degree of communication between the decrease-side oil passage 58 and the decrease-side drain oil passage 60 increases, and the degree of communication between the increase-side oil passage 59 and the increase-side drain oil passage 61 decreases. Thus, as illustrated in FIG. 6, the hydraulic pressure (see the solid line) of the decrease-side control pressure chamber 15A decreases, and the hydraulic pressure (see the broken line) of the increase-side control pressure chamber 15B increases. When the duty ratio of applied current in the second direction is 50%, the hydraulic pressure of the increase-side control pressure chamber 15B maximally increases. Thus, the pump casing 14 is held at the maximum swing position on the increase side, as illustrated in FIG. 3 (e.g. a middle to high load operation mode after a warm-up operation of the engine is completed or a high load operation mode). Specifically, the linear solenoid valve 20 adjusts the hydraulic pressure to be applied to the decrease-side control pressure chamber 15A and the hydraulic pressure to be applied to the increase-side control pressure chamber 15B to be equal to the hydraulic pressure when the pump casing 14 is held at the maximum swing position in the discharge amount increase direction.

Referring back to FIG. 1, the main gallery 56 is connected to respective oil supply portions of the crankshaft 2, a camshaft 3, a hydraulic lash adjuster 4, a VVT 5, and an oil jet 6. The controller 30 sets a target hydraulic pressure depending on an operating state of the engine, based on detection information from a hydraulic pressure sensor 31

(corresponding to a hydraulic pressure detecting device of the invention) for detecting a hydraulic pressure of the main gallery 56, from a crank angle sensor 32 for detecting a rotating angle of the crankshaft 2, from an airflow sensor 33 for detecting an amount of air to be sucked by the engine, from an oil temperature sensor 34 for detecting an oil temperature of the main gallery 56, from a cam angle sensor 35 for detecting a swing phase of the camshaft 3; and from a coolant temperature sensor 36 for detecting a temperature of coolant for the engine. The controller 30 controls the linear solenoid valve 20 in such a manner that the hydraulic pressure to be detected by the hydraulic pressure sensor 31 becomes equal to the predetermined target hydraulic pressure.

Figure 7:
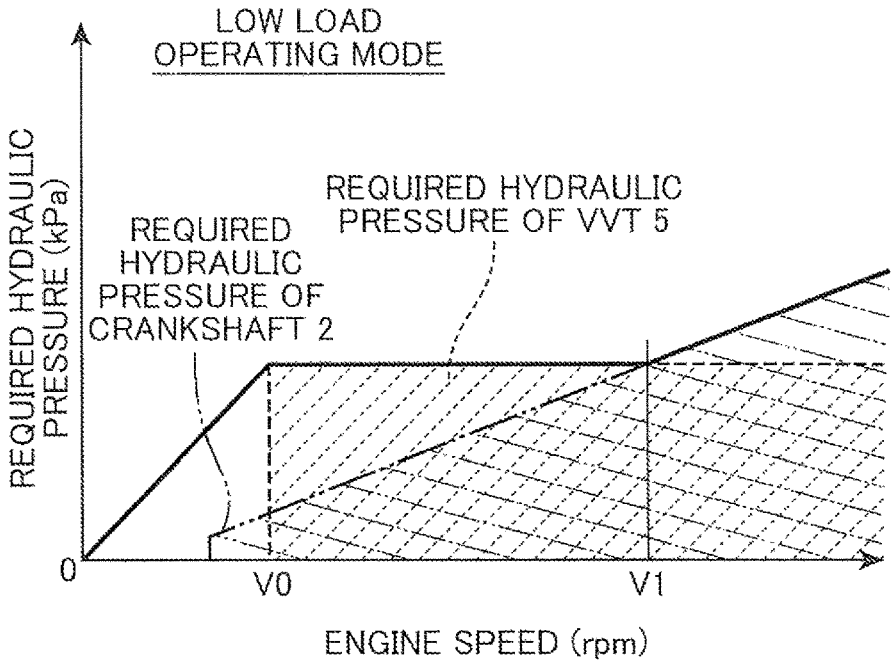
FIG. 7 is a characteristic diagram illustrating a relationship between a required hydraulic pressure of a main gallery and an engine speed when an engine is in a low load operation mode.
Figure 8:
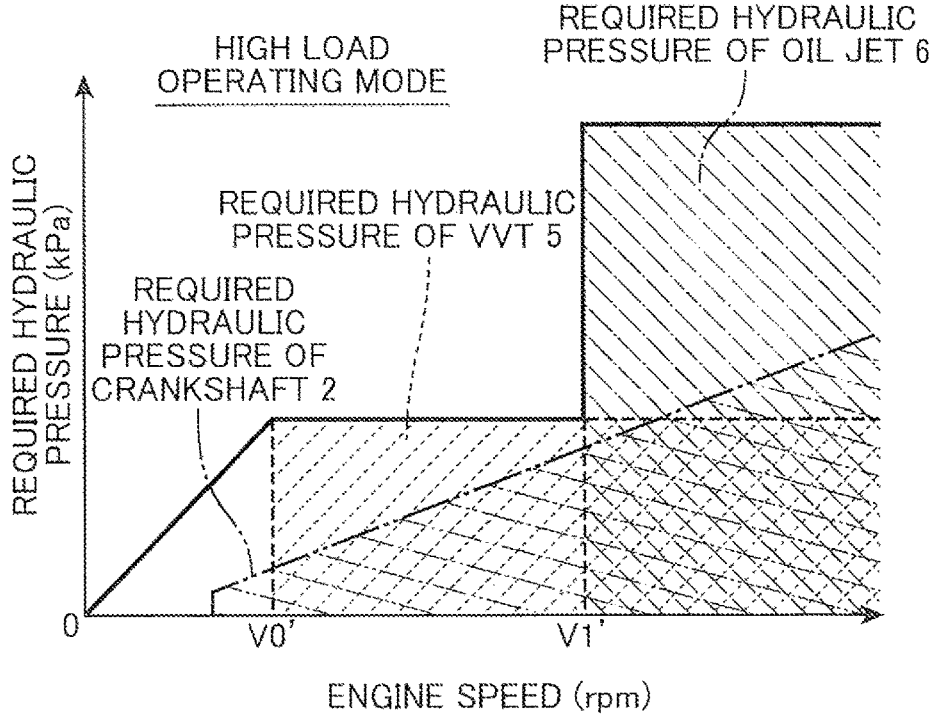
FIG. 8 is a characteristic diagram illustrating a relationship between a required hydraulic pressure of the main gallery and an engine speed when the engine is in a high load operation mode.

FIG. 7 is a map illustrating a relationship between an engine speed, and a required hydraulic pressure of each of the oil supply portions when the engine is in a low load operation mode. FIG. 8 is a map illustrating a relationship between an engine speed, and a required hydraulic pressure of each of the oil supply portions when the engine is in a high load operation mode.

As illustrated in FIG. 7, the oil supply portion of the crankshaft 2 and the oil supply portion of the VVT 5 have a relatively high required hydraulic pressure when the engine is operated in a low load operation mode. When the engine speed is equal to or lower than V1, the required hydraulic pressure of the VVT 5 is highest. When the engine speed exceeds V1, the required hydraulic pressure of the crankshaft 2 is highest.

On the other hand, as illustrated in FIG. 8, the oil supply portion of the crankshaft 2, the oil supply portion of the VVT 5, and the oil supply portion of the oil jet 6 have a relatively high required hydraulic pressure when the engine is operated in a high load operation mode. When the engine speed is equal to or lower than V1', the required hydraulic pressure of the VVT 5 is highest. When the engine speed exceeds V1', the required hydraulic pressure of the oil jet 6 is highest.

The controller 30 stores the maps as illustrated in FIG. 7 and FIG. 8 in a memory, and sets a highest required hydraulic pressure (the required hydraulic pressure indicated by the solid line in each of FIG. 7 and FIG. 8) from the maps, as a target hydraulic pressure, depending on an operating state of the engine. The controller 30 feedback controls the linear solenoid valve 20 in such a manner that the hydraulic pressure to be detected by the hydraulic pressure sensor 31 becomes equal to the predetermined target hydraulic pressure.

Further, the controller 30 determines that the oil pump 10 is in an anomalous state when a difference between the hydraulic pressure to be detected by the hydraulic pressure sensor 31 and the predetermined target hydraulic pressure is equal to or larger than a predetermined value after feedback control of the linear solenoid valve 20 is executed. When it is determined that the oil pump 10 is in an anomalous state, the controller 30 controls the linear solenoid valve 20 to alternately apply a hydraulic pressure to the decrease-side control pressure chamber 15A and to the increase-side control pressure chamber 15B so that a cleaning mode of causing the pump casing 14 to alternately swing toward the decrease side (in the discharge amount decrease direction) and the increase side (in the discharge amount increase direction) is executed.

Next, the advantageous effects of the embodiment are described.

(1) The oil pump device in the embodiment is provided with the capacity-variable oil pump 10, and the linear solenoid valve 20 for changing the discharge amount of oil from the oil pump 10. The oil pump 10 is provided with the pump casing 14 configured to decrease the discharge amount of the oil pump 10 by swinging toward the decrease side (in the discharge amount decrease direction), and to increase the discharge amount of the oil pump 10 by swinging toward the increase side (in the discharge amount increase direction); the decrease-side control pressure chamber 15A configured to cause the pump casing 14 to swing toward the decrease side in response to receiving a hydraulic pressure; the increase-side control pressure chamber 15B configured to cause the pump casing 14 to swing toward the increase side in response to receiving a hydraulic pressure; the decrease-side return spring 16 disposed in the decrease-side control pressure chamber 15A and configured to urge the pump casing 14 in the discharge amount decrease direction; the increase-side return spring 17 disposed in the increase-side control pressure chamber 15B and configured to urge the pump casing 14 in the discharge amount increase direction; and the linear solenoid valve 20 configured to adjust the hydraulic pressure to be applied to the decrease-side control pressure chamber 15A and the hydraulic pressure to be applied to the increase-side control pressure chamber 15B. The linear solenoid valve 20 adjusts the hydraulic pressure to be applied to the decrease-side control pressure chamber 15A and the hydraulic pressure to be applied to the increase-side control pressure chamber 15B by balancing the urging force of the decrease-side return spring 16 and the urging force of the increase-side return spring 17 so as to hold the pump casing 14 at the approximately intermediate position between the maximum swing position on the decrease side and the maximum swing position on the increase side when supply of current to the linear solenoid valve 20 is stopped. According to this configuration, when the linear solenoid valve 20 is in a non-energized state, it is possible to keep the discharge amount of the oil pump 10 to the approximately intermediate discharge amount between the minimum discharge amount (discharge amount when the pump casing 14 is caused to swing maximally toward the decrease side), and the maximum discharge amount (discharge amount when the pump casing 14 is caused to swing maximally toward the increase side). The intermediate discharge amount is required when the engine is operated in a low load operation mode, which is frequently used for the engine. In other words, the linear solenoid valve 20 is brought to a non-energized state in the engine operating range, which is frequently used for the engine. This is advantageous in suppressing electric power consumption of the linear solenoid valve 20.

Further, when the discharge amount of the oil pump 10 decreases or increases from the intermediate discharge amount (discharge amount when the linear solenoid valve 20 is in a non-energized state) to the minimum discharge amount or to the maximum discharge amount (discharge amount when the linear solenoid valve 20 is in an energized state), the decrement of discharge amount or the increment of discharge amount is small, as compared with a case in which the discharge amount of the oil pump 10 decreases from the maximum discharge amount to the minimum discharge amount, or a case in which the discharge amount of the oil pump 10 increases from the minimum discharge amount to the maximum discharge amount. This does not require a high hydraulic pressure. Thus, it is possible to control the discharge amount of the oil pump 10 with enhanced responsiveness even when oil of a low viscosity is used.

Figure 9:
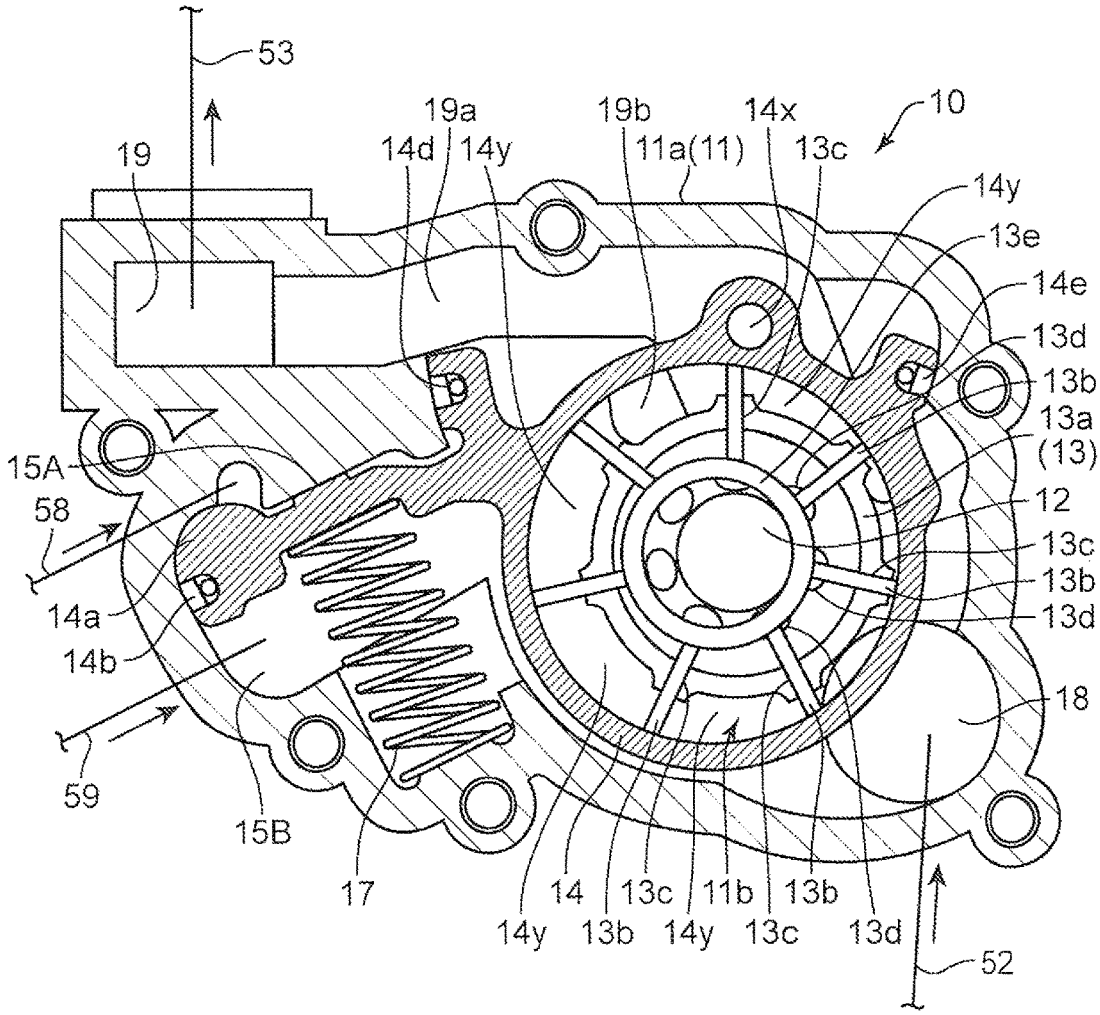
FIG. 9 is an overall diagram illustrating an operating state of a conventional variable-capacity oil pump when an electrically operated control valve is in a non-energized state.

For instance, as illustrated in FIG. 9, let us assume a conventional variable-capacity oil pump 10 configured such that an increase-side return spring 17 is disposed in an increase-side control pressure chamber 15B, but a decrease-side return spring 16 is not disposed in a decrease-side control pressure chamber 15A. In the conventional oil pump 10, when a linear solenoid valve 20 is in a non-energized state, a pump casing 14 is caused to swing toward the increase side, as illustrated in FIG. 9, and the discharge amount of the oil pump 10 increases; and when the linear solenoid valve 20 is in an energized state, the pump casing 14 is caused to swing toward the decrease side, and the discharge amount of the oil pump 10 decreases. According to the aforementioned configuration, as illustrated by the conventional art portion in FIG. 10, current is constantly supplied to the linear solenoid valve 20 when the engine is operated in a low load operation mode, which is frequently used for the engine (duty ratio: 50 to 100%). This may increase electric power consumption. In addition to the above, it is necessary to apply a force exceeding the urging force of the increase-side return spring 17 in order to cause the pump casing 14 to swing toward the decrease side. In order to decrease the discharge amount of the oil pump 10 with enhanced responsiveness, it is necessary to supply a relatively high hydraulic pressure to the decrease-side control pressure chamber 15A. Particularly, the latter issue is serious because the hydraulic pressure tends to lower when oil of a low viscosity is used in order to improve the fuel economy.

Figure 10:
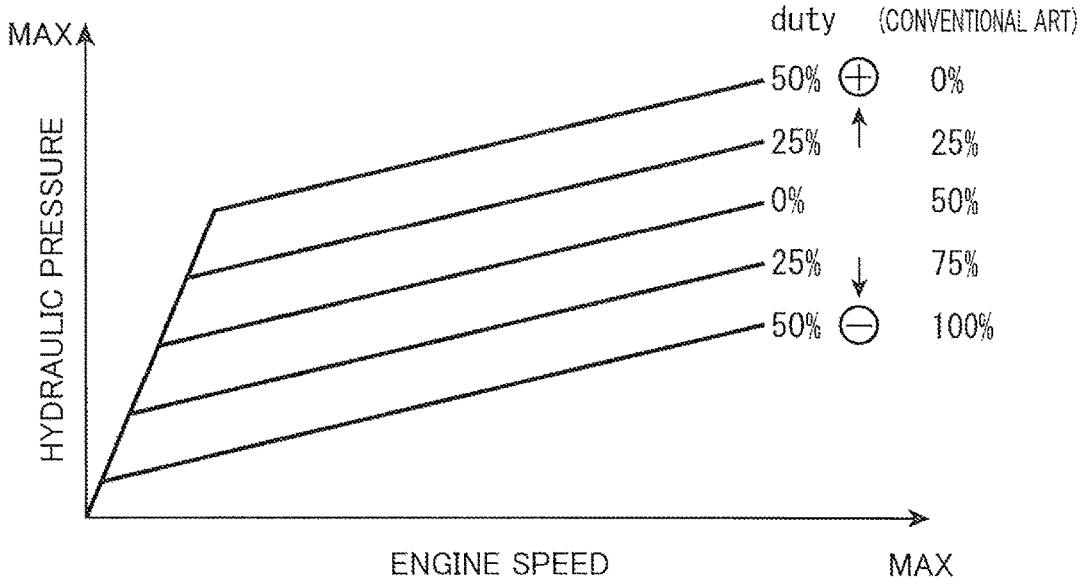
FIG. 10 is a characteristic diagram illustrating a difference between the oil pump of the embodiment and the conventional oil pump.

Contrary to the above, in the embodiment, as also illustrated in FIG. 10, the duty ratio is as small as from 0 to 50% when the engine is operated in a low load operation mode, which is frequently used for the engine. This is advantageous in reducing electric power consumption. Further, unlike the conventional art, the decrease-side return spring 16 is disposed in the decrease-side control pressure chamber 15A, in addition to the increase-side return spring 17 disposed in the increase-side control pressure chamber 15B. Therefore, when a hydraulic pressure is applied to the decrease-side control pressure chamber 15A, only the hydraulic pressure to be applied to the decrease-side control pressure chamber 15A is necessary, and it is not necessary to apply a force exceeding the urging force of the increase-side return spring 17. This does not require a high hydraulic pressure. Thus, it is possible to use oil of a low viscosity without any inconvenience in order to improve the fuel economy.

(2) In the embodiment, the decrease-side control pressure chamber 15A and the increase-side control pressure chamber 15B are respectively provided with the decrease-side return spring 16 for urging the pump casing 14 toward the decrease side, and the increase-side return spring 17 for urging the pump casing 14 toward the increase side. The linear solenoid valve 20 is configured to adjust a hydraulic pressure to be applied to the decrease-side control pressure chamber 15A and a hydraulic pressure to be applied to the increase-side control pressure chamber 15B in such a manner that the pump casing 14 is held at the intermediate position by balancing the urging force of the decrease-side return spring 16 and the urging force of the increase-side return spring 17. This makes it possible to stably and precisely hold the pump casing 14 at the approximately intermediate position by the urging force of the decrease-side return spring 16 and the urging force of the increase-side return spring 17 respectively acting on the decrease-side control pressure chamber 15A and on the increase-side control pressure chamber 15B.

There may be a case, in which a hydraulic pressure is not applied either to the decrease-side control pressure chamber 15A or to the increase-side control pressure chamber 15B. Specifically, in FIG. 6, when the linear solenoid valve 20 is in a non-energized state in which the applied current to the linear solenoid valve 20 is zero, the hydraulic pressure (see the solid line) of the decrease-side control pressure chamber 15A and the hydraulic pressure (see the broken line) of the increase-side control pressure chamber 15B are set to zero, and the pump casing 14 is held at the approximately intermediate position by balancing the urging force of the decrease-side return spring 16 and the urging force of the increase-side return spring 17. In this case, it is possible to reduce the pressure receiving area of each of the decrease-side control pressure chamber 15A and the increase-side control pressure chamber 15B. This is advantageous in miniaturizing the oil pump 10.

(3) In the embodiment, the controller 30 sets a target hydraulic pressure depending on an operating state of the engine. The hydraulic pressure sensor 31 detects a hydraulic pressure of the main gallery 56 from the oil pump 10. The controller 30 controls the linear solenoid valve 20 in such a manner that the hydraulic pressure to be detected by the hydraulic pressure sensor 31 is equal to the predetermined target hydraulic pressure. This makes it possible to implement a target hydraulic pressure with enhanced responsiveness and with precision depending on an operating state of the engine.

(4) In the embodiment, the controller 30 determines that the oil pump 10 is in an anomalous state when a difference between the hydraulic pressure to be detected by the hydraulic pressure sensor 31 and the predetermined target hydraulic pressure is equal to or larger than a predetermined value after feedback control of the linear solenoid valve 20 is executed. When it is determined that the oil pump 10 is in an anomalous state, the linear solenoid valve 20 is controlled to alternately apply a hydraulic pressure to the decrease-side control pressure chamber 15A and to the increase-side control pressure chamber 15B so that a cleaning mode of causing the pump casing 14 to alternately swing toward the decrease side (in the discharge amount decrease direction) and the increase side (in the discharge amount increase direction) is executed. This makes it possible to easily and securely eliminate operation anomalies of the oil pump 10 due to intrusion of foreign matter, for instance, when foreign matter such as waste or debris generated during a manufacturing process may intrude into the decrease-side return spring 16 or into the increase-side return spring 17.

The invention has been described in details by the embodiment. The invention, however, is not limited to the embodiment. It is possible to modify the shapes of the constituent elements or the number of the constituent elements in various ways, as far as such modifications do not depart from the gist of the invention.

For instance, the linear solenoid valve 20 may be configured such that one of the unillustrated solenoids is mounted on one axial end of the spool 22, and the other one of the unillustrated solenoids is mounted on the other axial end of the spool 22 so that the spool 22 is moved toward the decrease side (left side in FIG. 5) by controlling energization of the one solenoid, and that the spool 22 is moved toward the increase side (right side in FIG. 5) by controlling energization of the other solenoid.

The following is a summary of the invention described above.

An oil pump device according to the invention is the oil pump device for an engine. The oil pump device is provided with an oil pump; and an electrically operated control valve which changes a discharge amount of oil from the oil pump. The oil pump includes: a pump body provided with an oil suction port and an oil discharge port; a pump element disposed inside the pump body, and configured to rotate by a driving force of a crankshaft; a pump casing disposed inside the pump body and around the pump element, the pump casing forming a plurality of pump chambers by cooperation with the pump element, the pump chambers communicating with the suction port and with the discharge port one after another, as the pump element is rotated, the pump casing being supported by the pump body to swing in a discharge amount decrease direction and in a discharge amount increase direction, the discharge amount decrease direction being such that a capacity of the pump chamber located at a position close to the suction port increases and a capacity of the pump chamber located at a position close to the discharge port decreases, the discharge amount increase direction being opposite to the discharge amount decrease direction, and being such that a capacity of the pump chamber located at a position close to the discharge port increases and a capacity of the pump chamber located at a position close to the suction port decreases; a decrease-side control pressure chamber defined by the pump body and the pump casing, and configured to cause the pump casing to swing in the discharge amount decrease direction in response to receiving a hydraulic pressure; an increase-side control pressure chamber defined by the pump body and the pump casing, and configured to cause the pump casing to swing in the discharge amount increase direction in response to receiving a hydraulic pressure; a decrease-side return spring disposed in the decrease-side control pressure chamber in a compressed state between the pump body and the pump casing, and configured to constantly urge the pump casing in the discharge amount decrease direction; and an increase-side return spring disposed in the increase-side control pressure chamber in a compressed state between the pump body and the pump casing, and configured to constantly urge the pump casing in the discharge amount increase direction. The electrically operated control valve adjusts the hydraulic pressure to be applied to the decrease-side control pressure chamber and the hydraulic pressure to be applied to the increase-side control pressure chamber so as to hold the pump casing at a predetermined position by balancing an urging force of the decrease-side return spring and an urging force of the increase-side return spring when supply of current to the electrically operated control valve is stopped, the predetermined position being an approximately intermediate position between a maximum swing position in the discharge amount decrease direction and a maximum swing position in the discharge amount increase direction, and being a position where the capacity of the pump chamber located at the position close to the suction port and the capacity of the pump chamber located at the position close to the discharge port are approximately equal to each other.

According to the aforementioned configuration, when the electrically operated control valve is in a non-energized state, the discharge amount of the oil pump is kept at an approximately intermediate discharge amount between the minimum discharge amount (discharge amount when the pump casing is caused to swing maximally in the discharge amount decrease direction), and the maximum discharge amount (discharge amount when the pump casing is caused to swing maximally in the discharge amount increase direction). The intermediate discharge amount is required when the engine is operated in a low load operation mode, which is frequently used for the engine. In other words, the electrically operated control valve is brought to a non-energized state in the engine operating range, which is frequently used for the engine. This is advantageous in suppressing electric power consumption of the electrically operated control valve.

Further, when the discharge amount of the oil pump decreases or increases from the intermediate discharge amount (discharge amount when the electrically operated control valve is in a non-energized state) to the minimum discharge amount or to the maximum discharge amount (discharge amount when the electrically operated control valve is in an energized state), the decrement of discharge amount or the increment of discharge amount is small, for instance, as compared with a case in which the discharge amount of the oil pump decreases from the maximum discharge amount to the minimum discharge amount, or a case in which the discharge amount of the oil pump increases from the minimum discharge amount to the maximum discharge amount. This does not require a high hydraulic pressure. Thus, it is possible to control the discharge amount of the oil pump with enhanced responsiveness even when oil of a low viscosity is used.

Further, according to the aforementioned configuration, the decrease-side return spring for urging the pump casing toward the decrease side, and the increase-side return spring for urging the pump casing toward the increase side are respectively disposed in the decrease-side control pressure chamber and in the increase-side control pressure chamber. The electrically operated control valve adjusts the hydraulic pressure to be applied to the decrease-side control pressure chamber and the hydraulic pressure to be applied to the increase-side control pressure chamber so as to hold the pump casing at the approximately intermediate position by balancing the urging force of the decrease-side return spring and the urging force of the increase-side return spring. This makes it possible to stably and precisely hold the pump casing at the approximately intermediate position by the urging force of the decrease-side return spring and the urging force of the increase-side return spring respectively acting on the decrease-side control pressure chamber and on the increase-side control pressure chamber. The decrease-side return spring is disposed in the decrease-side control pressure chamber, and the increase-side return spring is disposed in the increase-side control pressure chamber. Therefore, when a hydraulic pressure is applied to one of the control pressure chambers, it is not necessary to apply a force exceeding the urging force of the return spring in the other of the control pressure chambers. Thus, a high hydraulic pressure is not required.

In the oil pump device, preferably, the electrically operated control valve may adjust the hydraulic pressure to be applied to the decrease-side control pressure chamber and the hydraulic pressure to be applied to the increase-side control pressure chamber in such a manner that a difference in hydraulic pressure between the decrease-side control pressure chamber and the increase-side control pressure chamber is substantially zero when supply of current to the electrically operated control valve is stopped. Each of the decrease-side return spring and the increase-side return spring may have a resilient force capable of holding the pump casing at the predetermined position when the supply of current to the electrically operated control valve is stopped.

According to the aforementioned configuration, there may be a case in which a hydraulic pressure is not supplied either to the decrease-side control pressure chamber or to the increase-side control pressure chamber. In this case, it is possible to reduce the pressure receiving area of each of the decrease-side control pressure chamber and the increase-side control pressure chamber. This is advantageous in miniaturizing the oil pump.

In the oil pump device, preferably, the electrically operated control valve may adjust the hydraulic pressure to be applied to the decrease-side control pressure chamber and the hydraulic pressure to be applied to the increase-side control pressure chamber by a duty ratio of current to be supplied to the electrically operated control valve in such a manner that when the oil pump is in a first current supply state in which current is supplied to the electrically operated control valve in a certain direction and the duty ratio is about 50%, the hydraulic pressure to be applied to the decrease-side control pressure chamber and the hydraulic pressure to be applied to the increase-side control pressure chamber are adjusted to be equal to a hydraulic pressure when the pump casing is held at the maximum swing position in the discharge amount decrease direction, and that when the oil pump is in a second current supply state in which current is supplied to the electrically operated control valve in a direction opposite to the direction in the first current supply state and the duty ratio is about 50%, the hydraulic pressure to be applied to the decrease-side control pressure chamber and the hydraulic pressure to be applied to the increase-side control pressure chamber are adjusted to be equal to a hydraulic pressure when the pump casing is held at the maximum swing position in the discharge amount increase direction.

According to the aforementioned configuration, the duty ratio when the engine is operated in a low load operation mode, which is frequently used for the engine, is as small as from 0 to 50%. This is advantageous in reducing electric power consumption.

Preferably, the oil pump may be further provided with a control pressure oil passage which supplies a hydraulic pressure for use in changing the discharge amount of oil from the oil pump, the control pressure oil passage communicating with the electrically operated control valve; a decrease-side oil passage which communicates between the electrically operated control valve and the decrease-side control pressure chamber; and an increase-side oil passage which communicates between the electrically operated control valve and the increase-side control pressure chamber. The electrically operated control valve may be a solenoid valve provided with a valve body to be connected to each of the control pressure oil passage, the decrease-side oil passage, and the increase-side oil passage, and a spool displaceable in response to supply of current to the electrically operated control valve for changing a communication state between the control pressure oil passage and the decrease-side oil passage, and a communication state between the control pressure oil passage and the increase-side oil passage. The spool may have such a shape that when supply of current to the electrically operated control valve is stopped, a degree of communication between the control pressure oil passage and the decrease-side oil passage, and a degree of communication between the control pressure oil passage and the increase-side oil passage are set to be substantially zero, when the oil pump is in the first current supply state, the degree of communication between the control pressure oil passage and the decrease-side oil passage is set to a substantially maximum value, and the degree of communication between the control pressure oil passage and the increase-side oil passage is set to a substantially minimum value, and when the oil pump is in the second current supply state, the degree of communication between the control pressure oil passage and the decrease-side oil passage is set to a substantially minimum value, and the degree of communication between the control pressure oil passage and the increase-side oil passage is set to a substantially maximum value.

According to the aforementioned configuration, it is possible to adjust the hydraulic pressure to be applied to the decrease-side control pressure chamber and the hydraulic pressure to be applied to the increase-side control pressure chamber in a satisfactory manner by the duty ratio of current.

Preferably, the oil pump device may be further provided with a target hydraulic pressure setting device which sets a target hydraulic pressure depending on an operating state of the engine; a hydraulic pressure detecting device which detects a hydraulic pressure of an oil supply passage from the oil pump; and a control device which controls the electrically operated control valve in such a manner that the hydraulic pressure to be detected by the hydraulic pressure detecting device is equal to the target hydraulic pressure to be set by the target hydraulic pressure setting device.

According to the aforementioned configuration, it is possible to implement a target hydraulic pressure with enhanced responsiveness and with precision depending on an operating state of the engine.

In the oil pump, preferably, the control device may determine that the oil pump is in an anomalous state when a difference between the hydraulic pressure to be detected by the hydraulic pressure detecting device and the target hydraulic pressure to be set by the target hydraulic pressure setting device is equal to or larger than a predetermined value after the control is executed. When it is determined that the oil pump is in an anomalous state, the control device may control the electrically operated control valve to alternately apply a hydraulic pressure to the decrease-side control pressure chamber and to the increase-side control pressure chamber so that a cleaning mode of causing the pump casing to swing alternately in the discharge amount decrease direction and in the discharge amount increase direction is executed.

According to the aforementioned configuration, it is possible to easily and securely eliminate operation anomalies of the oil pump due to intrusion of foreign matter such as waste or debris generated during a manufacturing process.

This application is based on Japanese Patent Application No. 2015-108460 filed on May 28, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An oil pump device for an engine, comprising:

a variable-capacity oil pump; and an electrically operated control valve which changes a discharge amount of oil from the oil pump, the oil pump including:

a pump body provided with an oil suction port and an oil discharge port;

a pump element disposed inside the pump body, and configured to rotate by a driving force of a crankshaft;

a pump casing disposed inside the pump body and around the pump element, the pump casing forming a plurality of pump chambers by cooperation with the pump element, the pump chambers communicating with the suction port and with the discharge port one after another, as the pump element is rotated, the pump casing being supported by the pump body to swing in a discharge amount decrease direction and in a discharge amount increase direction, the discharge amount decrease direction being such that a capacity of one pump chamber located at a position close to the suction port among the plurality of pump chambers increases and a capacity of another pump chamber located at a position close to the discharge port among the plurality of pump chambers decreases, the discharge amount increase direction being opposite to the discharge amount decrease direction, and being such that the capacity of the another pump chamber located at the position close to the discharge port among the plurality of pump chambers increases and the capacity of the one pump chamber located at the position close to the suction port among the plurality of pump chambers decreases;

a decrease-side control pressure chamber defined by the pump body and the pump casing, and configured to cause the pump casing to swing in the discharge amount decrease direction in response to receiving a hydraulic pressure;

an increase-side control pressure chamber defined by the pump body and the pump casing, and configured to cause the pump casing to swing in the discharge amount increase direction in response to receiving a hydraulic pressure;

a decrease-side return spring disposed in the decrease-side control pressure chamber in a compressed state between the pump body and the pump casing, and configured to constantly urge the pump casing in the discharge amount decrease direction; and an increase-side return spring disposed in the increase-side control pressure chamber in a compressed state between the pump body and the pump casing, and configured to constantly urge the pump casing in the discharge amount increase direction, wherein the electrically operated control valve adjusts the hydraulic pressure to be applied to the decrease-side control pressure chamber and the hydraulic pressure to be applied to the increase-side control pressure chamber so as to hold the pump casing at a predetermined position by balancing an urging force of the decrease-side return spring and an urging force of the increase-side return spring when supply of current to the electrically operated control valve is stopped, the predetermined position being an approximately intermediate position between a maximum swing position in the discharge amount decrease direction and a maximum swing position in the discharge amount increase direction, and being a position where the capacity of the pump chamber located at the position close to the suction port and the capacity of the pump chamber located at the position close to the discharge port are approximately equal to each other.

2. The oil pump device according to claim 1, further comprising:

a target hydraulic pressure setting device which sets a target hydraulic pressure depending on an operating state of the engine;

a hydraulic pressure detecting device which detects a hydraulic pressure of an oil supply passage from the oil pump; and a control device which controls the electrically operated control valve in such a manner that the hydraulic pressure to be detected by the hydraulic pressure detecting device is equal to the target hydraulic pressure to be set by the target hydraulic pressure setting device.

3. The oil pump device according to claim 2, wherein the control device determines that the oil pump is in an anomalous state when a difference between the hydraulic pressure to be detected by the hydraulic pressure detecting device and the target hydraulic pressure to be set by the target hydraulic pressure setting device is equal to or larger than a predetermined value after the control is executed, and when it is determined that the oil pump is in the anomalous state, the control device controls the electrically operated control valve to alternately apply a hydraulic pressure to the decrease-side control pressure chamber and to the increase-side control pressure chamber so that a cleaning mode of causing the pump casing to swing alternately in the discharge amount decrease direction and in the discharge amount increase direction is executed.

4. The oil pump device according to claim 1, wherein the electrically operated control valve adjusts the hydraulic pressure to be applied to the decrease-side control pressure chamber and the hydraulic pressure to be applied to the increase-side control pressure chamber in such a manner that a difference in hydraulic pressure between the decrease-side control pressure chamber and the increase-side control pressure chamber is substantially zero when the supply of current to the electrically operated control valve is stopped, and each of the decrease-side return spring and the increase-side return spring has a resilient force capable of holding the pump casing at the predetermined position when the supply of current to the electrically operated control valve is stopped.

5. The oil pump device according to claim 4, wherein the electrically operated control valve adjusts the hydraulic pressure to be applied to the decrease-side control pressure chamber and the hydraulic pressure to be applied to the increase-side control pressure chamber by a duty ratio of current to be supplied to the electrically operated control valve in such a manner that when the oil pump is in a first current supply state in which current is supplied to the electrically operated control valve in a certain direction and the duty ratio is 50%, the hydraulic pressure to be applied to the decrease-side control pressure chamber and the hydraulic pressure to be applied to the increase-side control pressure chamber are adjusted to be equal to a hydraulic pressure when the pump casing is held at the maximum swing position in the discharge amount decrease direction, and that when the oil pump is in a second current supply state in which current is supplied to the electrically operated control valve in a direction opposite to the direction in the first current supply state and the duty ratio is 50%, the hydraulic pressure to be applied to the decrease-side control pressure chamber and the hydraulic pressure to be applied to the increase-side control pressure chamber are adjusted to be equal to a hydraulic pressure when the pump casing is held at the maximum swing position in the discharge amount increase direction.

6. The oil pump device according to claim 5, further comprising:

a control pressure oil passage which supplies a hydraulic pressure for use in changing the discharge amount of oil from the oil pump, the control pressure oil passage communicating with the electrically operated control valve;

a decrease-side oil passage which communicates between the electrically operated control valve and the decrease-side control pressure chamber; and an increase-side oil passage which communicates between the electrically operated control valve and the increase-side control pressure chamber, wherein the electrically operated control valve is a solenoid valve provided with a valve body to be connected to each of the control pressure oil passage, the decrease-side oil passage, and the increase-side oil passage, and a spool displaceable in response to supply of current to the electrically operated control valve for changing a communication state between the control pressure oil passage and the decrease-side oil passage, and a communication state between the control pressure oil passage and the increase-side oil passage, and the spool has such a shape that when supply of current to the electrically operated control valve is stopped, a degree of communication between the control pressure oil passage and the decrease-side oil passage, and a degree of communication between the control pressure oil passage and the increase-side oil passage are set to be substantially zero, when the oil pump is in the first current supply state, the degree of communication between the control pressure oil passage and the decrease-side oil passage is set to a substantially maximum value, and the degree of communication between the control pressure oil passage and the increase-side oil passage is set to a substantially minimum value, and when the oil pump is in the second current supply state, the degree of communication between the control pressure oil passage and the decrease-side oil passage is set to a substantially minimum value, and the degree of communication between the control pressure oil passage and the increase-side oil passage is set to a substantially maximum value.

* * * * *